US006533450B1

(12) United States Patent
Collins et al.

(10) Patent No.: US 6,533,450 B1
(45) Date of Patent: Mar. 18, 2003

(54) BOTTLE-TYPE TIMER

(76) Inventors: Dennis G. Collins, 6009 Calle R. Martinez Torres, Mayaguez, PR (US); Glenn H. Collins, 6009 Calle R. Martinez Torres, Mayaguez, PR (US)

( * ) Notice: Subject to any disclaimer, the term of this patent is extended or adjusted under 35 U.S.C. 154(b) by 0 days.

(21) Appl. No.: 09/679,736

(22) Filed: Oct. 5, 2000

Related U.S. Application Data

(60) Provisional application No. 60/218,524, filed on Jul. 17, 2000.

(51) Int. Cl.[7] ..... G04F 1/04; G04F 1/00
(52) U.S. Cl. ..... 368/93; 368/97
(58) Field of Search ..... 368/89, 93–95, 368/96, 97

(56) References Cited

U.S. PATENT DOCUMENTS

| | | | | |
|---|---|---|---|---|
| 2,466,573 A | * | 4/1949 | Brockley | 368/93 |
| 5,234,728 A | | 8/1993 | Chiang | |
| 5,819,991 A | | 10/1998 | Kohn et al. | |
| 6,012,960 A | | 1/2000 | Lee | |

OTHER PUBLICATIONS

E. Chen, K. Mei–Fang & R. Taylor, "How the Astronomical Clock Tower Worked," Sinorama, Jul. 1996, vol. 21, No. 7, http://magazines.sinanet.com/Sinorama/199607/article5/english//1.html, [Accessed Sep. 30, 2000].

"A Walk Through time," National Institute of Standards & Techonology–Physics Laboratory http://www.physics.nist.gov/GenInt/Time/early.html [Accessed Sep. 30,2000].

"Chinese Water Clocks," State University of New York Institute of Technology http://sts.sunyit.edu/timetech/chinese.html [Accessed Sep. 30,2000].

"Design and Décor., " The Thomas Jefferson Memorial Foundation, Inc., 1995, http://www.monticello.org/jefferson/toc.html [Accessed Sep. 30,2000].

"Welcome to Middleton," ValleyWeb.Com http://www.valleyweb.com/middleton/clock.html [Accessed Sep. 30,2000].

"Lyle Industries, Inc.," Lyle Industries, Inc. http://www.lyleindustris.com [Accessed Sep. 30,2000].

"Container Technology, Inc." Container Technology, Inc. http://www.contech.org [Accessed Sep. 30,2000].

"Mayfair Plastics" Mayfair Plastics http://www.mayfairplastics.com Accessed Sep. 30,2000.

"Automatic Control," Colliers Encyclopedia, Macmillan Education Company, 1991, Division of Macmillan, Inc., New York, pp. 322–326.

D. G. Zill and M. R. Cullen, "Differential Equations with Boundary–Value Problems," 1997, p. 181–183, Fourth Edition, Brooks/Cole Publishing Company, Pacific Grove, California.

Harry F. Olson, E.E., Ph.D., Dynamical Analogies, 1943, pp. 20 and 21, D. Van Nostrand Company, Inc., New York.

* cited by examiner

*Primary Examiner*—Vit Miska
(74) *Attorney, Agent, or Firm*—Patent Law Offices of Heath W. Hoglund

(57) ABSTRACT

A flexible state-of-the-art plastic bottle fitted with a sealed tube becomes a dynamic system for dispensing water or other fluid in nearly-uniform quantum amounts, in such a way that the apparatus may be used as (1) a timer, such as for cooking a three-minute egg; (2) a toy for enjoyment or learning how to count, etc.; or (3) a model for teaching differential equations or physics. The device is very simple, on the order of a paper clip.

16 Claims, 3 Drawing Sheets

BOTTLE-TYPE TIMER

This application claims the benefit of Provisional application Ser. No. 60/218,524, filed Jul. 17, 2000.

FIELD OF THE INVENTION

The invention relates to kitchen gadgets, water-play toys, and classroom demonstration models.

BACKGROUND OF THE INVENTION

Timers: Firstly the invention is related to clocks. A typical pendulum clock is a way of regulating the force of gravity, so that the work done raising weights can be expended in a controlled way. A second part of the clock translates the regular motion of the pendulum into time measurement. Another way of controlling the force of gravity in a controlled way, so as to measure time, is the hourglass, wherein work is done raising sand by turning over the hourglass, and the force of gravity pulling down the sand is controlled by a narrowing of the glass container, so that only a few grains of sand can pass through the "bottleneck" at a given instant.

Water clocks employing gravity to cause water to drip at a slow rate and thus measure time date to ancient Chinese dynasties. However there do not seem to be recent efforts to improve them.

Water-play toys: Devices for enjoyment of water flow, such as the bathtub rubber duck from which water can be squirted, abound. Many ingenious devices, such as U.S. Pat. No. 6,012,960 issued to Lee for a SPRINKLER TOY HANDLE PUMP, expand on this idea through mechanical means. Also such inventions can be pursued through electrical power, as for example in the U.S. Pat. No. 5,234,728 issued to Ming-Ann Chiang for a FOUNTAIN DEVICE. However such devices and others such as squirt guns employ quantum amounts of water only incidentally, for example by pulling the trigger repeatedly on a squirt gun.

Classroom demonstration models: There are many classroom models for demonstrating periodic motion, such as the tuning fork, which creates a sound by vibration of air. Here the cycles come too fast to count. Mechanical means with more visibility include the pendulum and the spring-mass system. Electrical means include the LC- or LCR-circuit coupled to various meters and oscilloscopes, or even more complicated electrical systems such as dynamos. However the amount of equipment required typically becomes so extensive that the devices are relegated to a laboratory, leaving nothing for classroom demonstration, for example in a mathematics class.

Non-linear or non-uniform models: Nonlinearities and non-uniform properties enter most demonstration models of periodic motion at some stage, for example due to resistance R in the LCR circuit. In some cases nonlinearities play an essential role in the operation of devices. However there is always room for demonstration models in which the nonlinearity or non-uniformity can be related in an understandable way to the results.

BRIEF SUMMARY OF THE INVENTION

According to one aspect of the invention, a bottle timer includes a clear plastic bottle and a chart extending along its side. The clear plastic bottle has a seal able cap so that it is capable of holding a fluid. The seal able cap has an open position that allows fluid to flow out of the interior chamber out of the clear plastic bottle. The seal able cap also has a closed position that prevents fluid from flowing out of the clear plastic bottle. The chart includes a first level corresponding to a start time and a second level corresponding to an end time. The flow of a fluid out of the clear plastic bottle from the first level to the second level represents a predetermined amount of time.

According to a further aspect of the invention, the clear plastic bottle includes flexible sides so that the flow of fluid out of the clear plastic bottle occurs in quantum amounts. More specifically, the flexible sides bend inward with the flow of fluid out of the clear plastic bottle. The flexible sides are restored to their initial position when air refills the vacuum created by the flow of fluid out of the clear plastic bottle. Typically, the pre-determined amount of time for the fluid level to drop from the first level to the second level is three minutes or less. The corresponding chart is calibrated in seconds.

According to another aspect of the invention, a bottle timer includes a plastic bottle, a tube and a graduated line. The plastic bottle includes an opening or aperture. The tube passes through the opening so that one end of the tube extends into the plastic bottle and another end of the tube extends out of the plastic bottle. The tube is sealed with the opening so that fluid flow out of the bottle must pass through the tube. The graduated line extends along the side of the plastic bottle. It is calibrated so that flow of the fluid out of the plastic bottle from a first level to a second level along the graduated line represents a period of time.

According to further aspects of the invention, the plastic bottle is constructed of clear, flexible plastic. The flexible sides cause the flow of fluid out of the plastic bottle to occur in quantum amounts. The tube is also constructed of plastic, such as a common plastic straw. A support attaches along a bottom portion of the plastic bottle at a position that avoids any interference with the flexible sides. A receptacle is positioned below the tube so that the receptacle catches the fluid that flows out of the plastic bottle.

According to still further aspects of the invention, another graduated line extending along the side of the plastic bottle. This graduated line is calibrated so that the flow of the fluid out of the plastic bottle in the quantum amounts from a first level to a second level represents the number of the quantum amounts (i.e. the quantum fluid flows).

BRIEF DESCRIPTION OF THE DRAWINGS

The invention may be understood by reference to the following description, with reference to the following figures in which.

DETAILED DESCRIPTION OF THE INVENTION

Figure 1A:
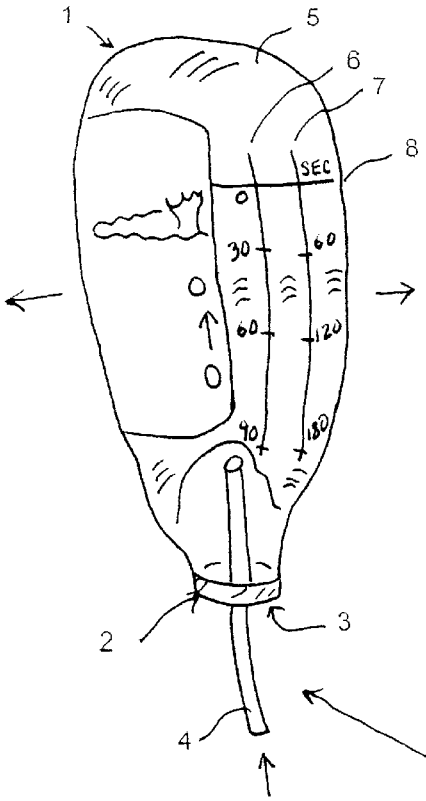
FIG. 1A is a perspective side view of one preferred bottle timer. This view includes a partial cross-section of the bottle timer. In this view, the bottle timer is shown as it fills a vacuum created by the flow of fluid out of the bottle timer.
Figure 1B:
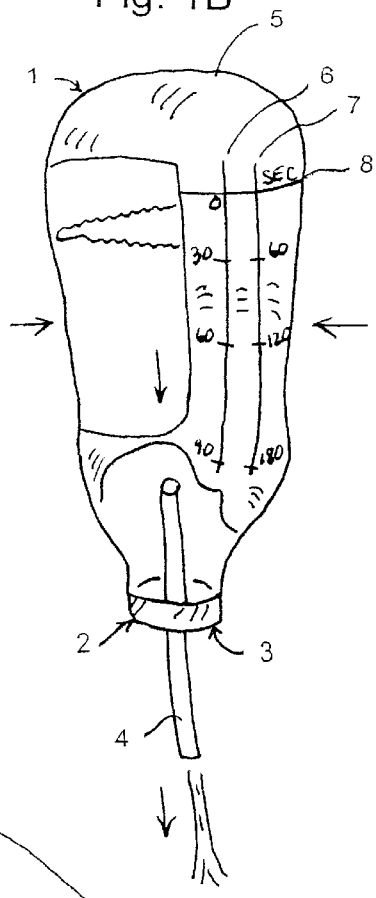
FIG. 1B is a perspective side view of the bottle timer of FIG. 1A. Again, this view includes a partial cross-section of the bottle timer. In this view, the bottle timer is shown as fluid flows out and creates a vacuum in the bottle timer.
Figure 1B:
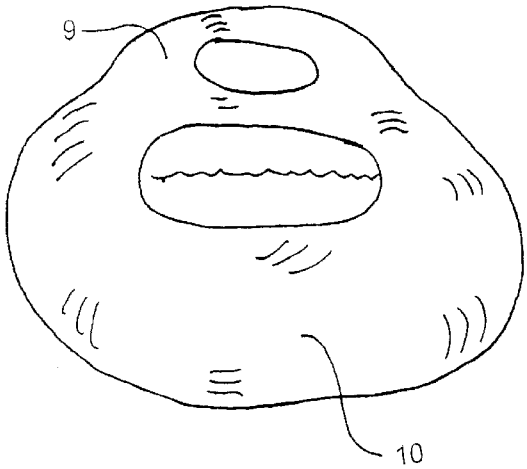
Figure 1C:
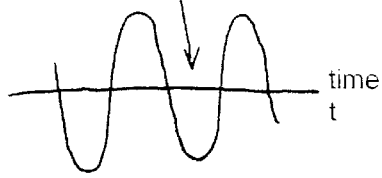
FIG. 1C is a graph showing the flow into and out of the bottle timer as a function of time. Liquid flow out is shown as negative, air flow into the bottle timer is shown as positive.

The invention provides a simple device that applies the gravity force to measure time. Here the force of gravity attempts to empty a suitably filled flexible plastic bottle. However the flow of fluid, typically but not necessarily water, is periodically opposed and stopped by the partial vacuum created in the bottle plus capillary force in the tube. Also periodically, the restoring force on the plastic bottle, in turn opposing the vacuum, causes the lowermost portion of the fluid to rise back up the tube with an inflow of air in volume (at atmospheric pressure) approximately equal to the quantum of fluid dispensed. Although there are many versions of water clocks, dating to ancient Chinese devices, they do not employ the physics of the described invention, which are based on the recently-invented clear plastic bottles for dispensing syrup, for example.

The typical plastic bottle, such as a pop bottle, does not have the necessary restoring force to maintain the periodic motion, or is too rigid, such as some plastic ketchup bottles. Another simple timing device employing controlled gravity is the hourglass, wherein the gravity force pulls sand through a narrow aperture in an "hourglass" shaped receptacle. However, the hourglass is subject to easy breakage, and stoppage of the sand at the "bottleneck." On the other hand, the flexible bottle is relatively unbreakable, although there can still be problems with stoppage of the dynamic action due to capillary force on water in the open tube.

The second part of the clock machinery, designed to count the number of pendulum swings, can be achieved by imprinting a vertical scale on the plastic bottle to measure the total amount of fluid dispensed. Of course in the present invention only a few minutes can be measured before the fluid empties out of the bottle. Nonetheless the bottle timer as claimed, in a version with a suitable support, such as a container fitting under the bottle to collect the water dispensed, can substitute for an hourglass in terms of timing, say, a three-minute egg. Also as some versions make a popping sound, it is possible to tell when the three minutes is up by when the water runs out and the sound stops.

Next the water-play toy aspect of the invention is discussed. Many water-play toys, such as the bathtub rubber duck, allow water to be squirted from a flexible container. However the uniform dispensing of water in quantum amounts is not involved. Here the bottle timer toy can be held in the hand while cyclically dispensing quantum amounts of water. It is fascinating to watch the cyclic operation of the bottle, which in the air intake part of the cycle either causes a series of rising bubbles or a fountain effect. The relatively slow operation of the cycle makes it ideal for teaching counting, as each quantum amount exits the bottle. Most other systems for water enjoyment require extensive equipment, with complicated valves, electrical wiring, and so on.

Thirdly the demonstration model aspect of the invention is discussed. The book *Dynamic Analogies* by Harry F. Olson (D. Van Nostrand, 1943) presents several means to implement simple harmonic motion, such as mechanical (pendulum or spring), rotational (rotating disk), and electrical (LC circuit). However no fluid analogy is included. Here the air intake and fluid outflow combine to represent harmonic motion. Further, the other methods require extensive apparatus. For example, to visualize the electric circuit version requires an oscilloscope plus power source and extensive wiring. The invention herein described can be simply held in the hand as it cycles quantum amounts of water, and requires only a minimal water source. Thus the device may greatly improve the teaching of concepts of simple harmonic motion in the classroom or even at the beach.

Water usually flows out continuously, but sometimes can be changed to discrete packets, as when water drips from a faucet, drop by drop. The drops are typically too small to study effectively. Here the quantum packets of fluid are much larger, so that the student can also ponder the origin of quantum effects, i.e. how continuous amounts of something can be changed into discrete packets. Observation of this device, with its periodic downward momentum involving water outflow, may also inspire students to think about how to create space drive mechanisms, and so on.

Finally, the invention serves as a model of non-uniform periodic motion. Most models, such as the pendulum and spring are actually non-uniform due to the effects of friction, so that the periodic motion becomes damped and dies out. In such cases the periodic motion becomes more difficult to observe. Here, although the periodic motion stops when the bottle empties; as will be explained later, the amplitude of the motion becomes larger, so that the periodic motion becomes easier to observe as the classroom demonstration progresses. Of course there are many types of non-uniform electronic devices; however as mentioned above, they require significant amounts of equipment to observe.

FIG. 1 sets forth a perspective view of the bottle-timer, in its operative position. A state-of-the-art flexible plastic bottle 1 for dispensing syrup or honey contains a seal able cap 2, which has an aperture 3 for dispensing small amounts of the syrup and a closing means, which is not necessary for the present invention. A clear plastic or other tube 4 (or straw) approximately 5"–10" long can be purchased as a standard hardware item, so that it seal-ably passes through and connects with the aperture 3 and extends downward from the bottle and cap, which are held upside down. A chart 5 may optionally be imprinted on or otherwise attached to the bottle to aid operation of the invention. The chart contains two or more graduated vertical lines 6 and 7 and a horizontal line 8, which indicates a priming level 8 for the start-up of the cyclic dispensing of the fluid, typically water. With the fluid above the priming level 8, the bottle must be periodically squeezed until the cycling becomes self-sustaining. The vertical scale 6 measures approximately, counting downward (with the bottle in inverted position); the number of cycles below the priming line that occur as the fluid cyclically exits the tube 4. The vertical scale 7 similarly measures approximately the time in appropriate units, such as seconds or minutes that pass, as the fluid empties out of the bottle from the priming level. Once the fluid has emptied from the bottle, the cap must be opened and the fluid re-filled before further operation of the invention. Other versions, familiar to those involved in plastic manufacture and molding, would be possible for seal-ably connecting the fluid-filling means (cap) to the bottle and the plastic tube to the bottle, which functions could be separated.

The amount of flexibility in the bottle is essential to the proper operation of the invention. U.S. Pat. No. 5,819,991 issued to Kohn et al. for a BOTTLE-TYPE PLASTIC CONTAINER discusses issues regarding flexibility and is incorporated herein by reference in its entirety. For the invention of this application any significant change of flexibility, sometimes even by removing the label from the syrup bottle, can prevent the device from operating. Typically, the bottle shape must be of oval or elliptical cross-section, so that well-defined symmetry-breaking can allow the sides to move in and out.

Also for the device to operate effectively, it can be combined with a support 9 and receptacle 10 for the expelled water. For the timer application, this support/receptacle can be as simple as detergent bottle, into the opening of which the bottle timer can be placed upside-down. Those skilled in the construction of such equipment can construct more elaborate supports as required. Of course the bottle timer cannot be supported from the middle section, which must be free to move in and out.

The manufacture of the device requires only the seal able connection of the bottle and cap and tube from pre-existing elements, plus such supports as desired. Two bottle types that are commercially available and which have proved effective are Aunt-Jemima Brand 24 oz. plastic syrup bottle and Sue Bee Clover Honey Brand 12 oz. plastic honey bottle, both of which contain seal able caps as required. Water can be replaced with colored water, water with suspended small metallic particles and so on, to make the display more exciting.

Careful study reveals that the quantum of water expelled may approximately double during the operation of the device and that the period of the cycle may increase. It is claimed the device can be modeled, besides the equation $y''+\omega^2 y=0$ of simple harmonic motion to a first approximation, to a better approximation by the second-order linear equation with variable coefficients:

$$y''+ay/(b+t)=0.$$

As time t increases, the denominator b+t increases, thereby decreasing the angular frequency $\omega^2$.

Figure 2:
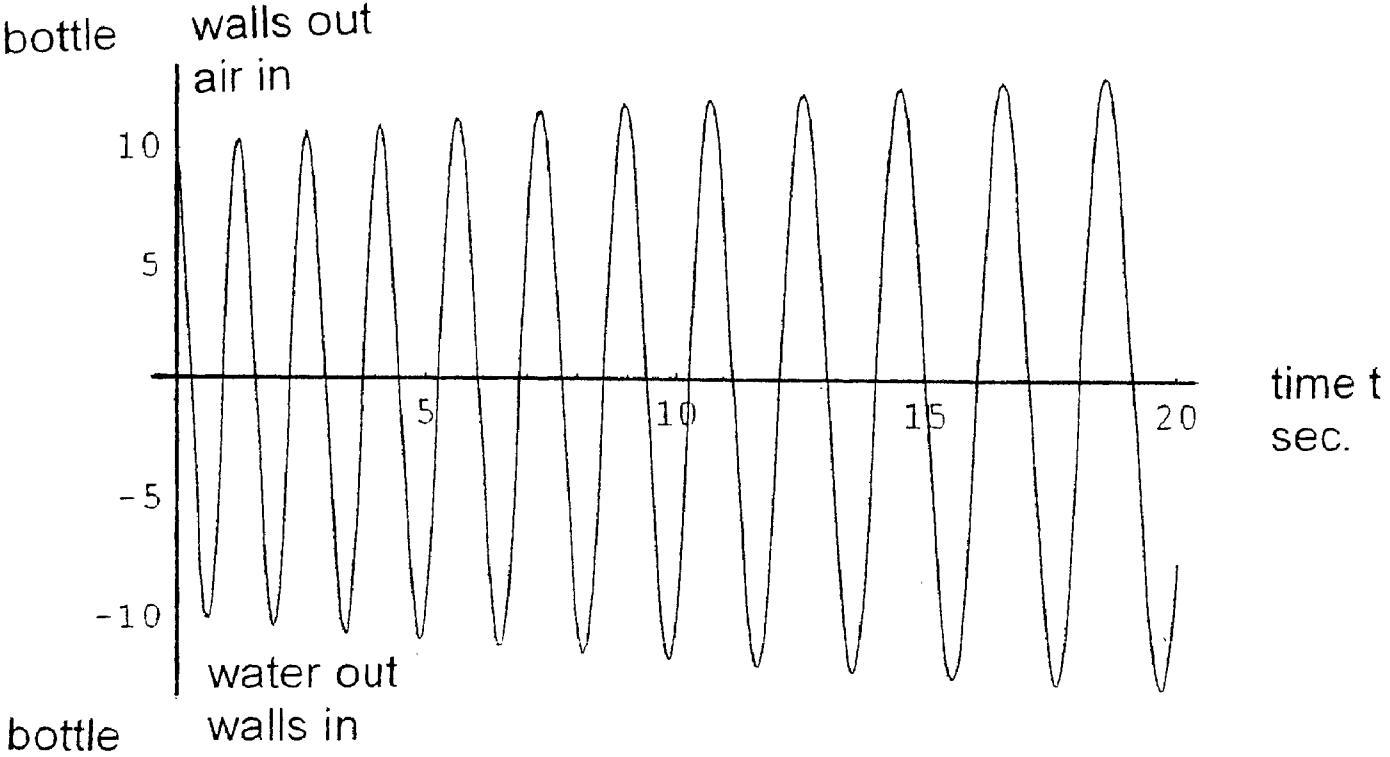
FIG. 2 is a graph showing the operation as the time output of a linear equation with constant coefficients that approximately describes the bottle timer model.

FIG. 2 shows the results of a Mathematica program that illustrates the output of the model differential equation, and approximates the output of the device. The program instructions are:

```
NDSolve[{y"[t]+(250/(10+t))*y[t]==0, y[ ]==10, y'[ ]==0},
  y[t], {t,0,25}]
Out[1]={{y[t]→InterpolatingFunction[{{0.,25.}}, < >][t]}}
In[4]:=Plot[Evaluate[y[t]/.% 1], {t,0,20}]
Out[4]=-Graphics-
```

As the water empties from the bottle, the airspace inside the bottle increases, so that more of the bottle participates in the restoring force and as a consequence, the cycling action becomes stronger as time progresses (t becomes larger). As mentioned before this feature distinguishes this model from most models of periodic motion. Also the increase of the period or cycle time can be directly linked to the increase in the size of the air chamber affected by the restoring force on the sides of the bottle. This process would be comparable to increasing the mass of a spring system or capacitance of an electrical circuit as the experiment proceeds.

Figure 3:
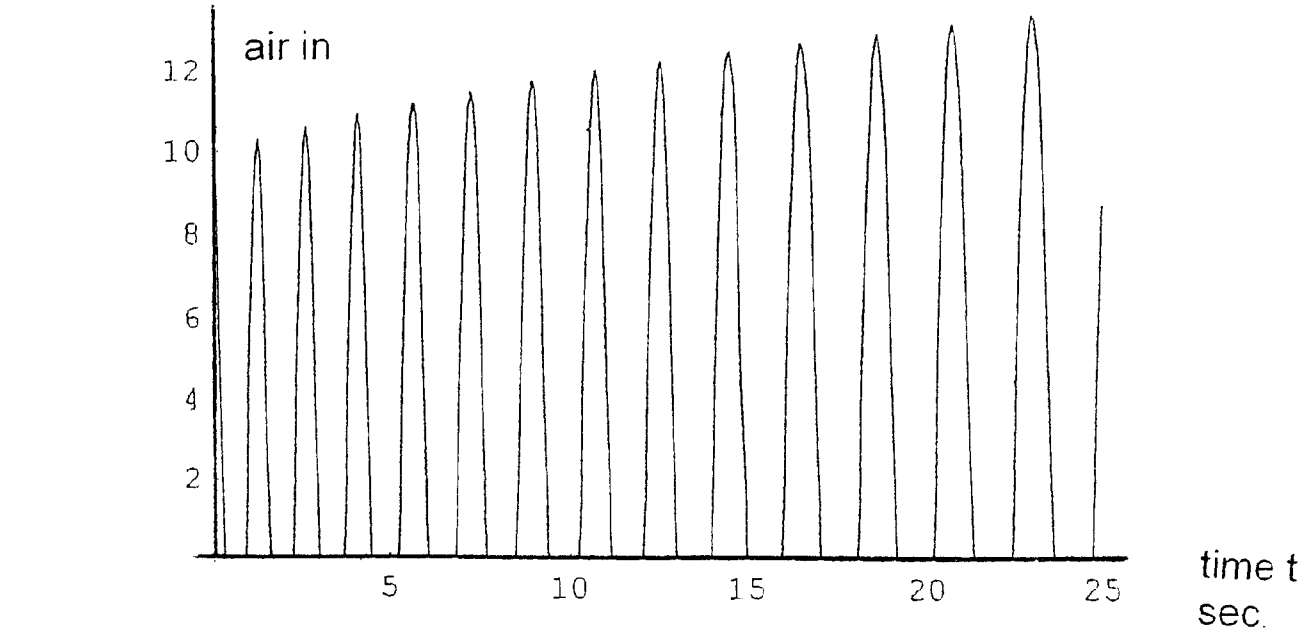
FIG. 3 is a graph showing the air intake part of the periodic motion.

FIG. 3 shows the results of a Mathematica program that illustrates the air intake part of the cycles; the integral of this function to time t represents the total air taken into the bottle (at atmospheric pressure) up to time t. The program instructions are:

```
In[1]:=NDSolve[{y"[t]+(250/(10+t))*y[t]==0,  y[0]==10,
  y'[0]==0}, y[t], {t,0,25}]
Out[1]={{y[t]→InterpolatingFunction[{{0.,25.}}, < >][t]}}
In[2]:=Plot[Max[0, Evaluate[y[t]/.% 1]], {t,0,25}]
Out[2]=-Graphics-
```

Although this integral is highly non-linear, it, plus the initial amount of air, can be approximated by the function b+t, appropriately scaled by a in the numerator or by a coefficient in front of t. The shape of the bottle induces nonlinearities. More exact mathematical models of the bottle timer would involve inhomogeneous terms due to gravity and fluid dynamical considerations.

Those skilled in the relevant arts will appreciate that many modifications can be made to the embodiments described herein without departing from the scope of the invention. The following claims are intended to cover all such modifications.

We claim:

1. A bottle timer comprising:

a clear plastic bottle having a seal able cap, wherein the interior of the clear plastic bottle and the seal able cap define an interior chamber configured to hold a fluid, and wherein the seal able cap has a first open position that allows fluid communication from the interior chamber out of the clear plastic bottle, and a second closed position that prevents fluid communication from the interior chamber out of the clear plastic bottle; and a chart extending along the side of the clear plastic bottle wherein the chart includes at least a first level corresponding to a start time and a second level corresponding to an end time and wherein the flow of a fluid out of the clear plastic bottle from the first level to the second level represents a pre-determined amount of time between the start time and the end time.

2. The bottle timer of claim 1, wherein the clear plastic bottle includes flexible sides so that the flow of fluid out of the clear plastic bottle occurs in quantum amounts in such a way that the flexible sides bend inward with the flow of fluid out of the clear plastic bottle.

3. The bottle timer of claim 1, wherein the pre-determined amount of time is less than ten minutes.

4. The bottle timer of claim 1, wherein the chart is calibrated in seconds.

5. The bottle timer of claim 1, wherein a cross-section of the clear plastic bottle is substantially oval.

6. The bottle timer of claim 2, wherein the cross-section of the clear plastic bottle is oval and defined specifically by an elliptical contour.

7. A bottle timer comprising:

a plastic bottle defining a cavity suitable for containing a fluid and defining an aperture in fluid communication with the cavity, wherein the plastic bottle comprises flexible sides configured so that the flow of fluid out of the plastic bottle occurs in quantum amounts;

a tube having a first end that extends into the cavity and a second end that extends outside of the cavity, wherein the tube passes through the aperture and is seal-ably attached thereto; and a graduated line extending along the side of the plastic bottle, wherein the graduated line is calibrated so that flow of the fluid out of the plastic bottle from a first level to a second level along the graduated line represents a period of time.

8. The bottle timer of claim 7, wherein the plastic bottle is constructed of a clear plastic.

9. The bottle timer of claim 7, wherein the tube comprises a plastic straw.

10. The bottle timer of claim 7, further comprising a support attached along a bottom portion of the plastic bottle and configured to avoid interference with any sides of the plastic bottle.

11. The bottle timer of claim 7, further comprising a receptacle positioned below the second end of the tube so that the receptacle catches the flow of fluid out of the plastic bottle.

12. The bottle timer of claim 7, wherein the plastic bottle defines an oval cross-section.

13. The bottle timer of claim 11, wherein the receptable comprises a plastic bottle.

14. The bottle timer of claim 11, wherein the receptable comprises a plastic bottle sealably connected to the outlet tube of the first bottle.

15. A bottle timer comprising:

a plastic bottle defining a cavity suitable for containing a fluid and defining an aperture in fluid communication with the cavity;

a tube having a first end that extends into the cavity and a second end that extends outside of the cavity, wherein the tube passes through the aperture and is seal-ably attached thereto;

a graduated line extending along the side of the plastic bottle, wherein the graduated line is calibrated so that flow of the fluid out of the plastic bottle from a first level to a second level along the graduated line represents a period of time; and a second graduated line extending along the side of the plastic bottle, wherein the second graduated line is calibrated so that the flow of the fluid out of the plastic bottle in the quantum amounts from a first level to a second level along the second graduated line represents a number of the quantum amounts.

16. A bottle timer comprising:

a plastic bottle defining a cavity suitable for containing a fluid and defining an aperture in fluid communication with the cavity, wherein the plastic bottle is constructed of clear plastic having flexible sides configured so that the flow of fluid out of the plastic bottle occurs in quantum amounts;

a tube having a first end that extends to the cavity and a second end that extends outside of the cavity, wherein the tube passes through the aperture and is seal-ably attached thereto, wherein the tube comprises a plastic straw;

a graduated line extending along the side of the plastic bottle, wherein the graduated line is calibrated so that flow of the fluid out of the plastic bottle from a first level to a second level along the graduated line represents a period of time;

a second graduated line extending along the side of the plastic bottle, wherein the second graduated line is calibrated so that the flow of the fluid out of the plastic bottle in the quantum amounts from a first level to a second level along the second graduated line represents a number of the quantum amounts;

a support attached along a bottom portion of the plastic bottle and configured to avoid interferenc e with any sides of the plastic bottle; and a receptacle positioned below the second end of the tube so that the receptacle catches the flow of fluid out of the plastic bottle.

* * * * *